United States Patent [19]

Potter

[11] Patent Number: 4,634,613

[45] Date of Patent: Jan. 6, 1987

[54] BOUGH TO TREE TRUNK CONNECTION FOR ARTIFICIAL TREE

[76] Inventor: Douglas S. Potter, 1252 Lakeshore Dr., Naples, Fla. 33940

[21] Appl. No.: 631,993

[22] Filed: Jul. 18, 1984

[51] Int. Cl.[4] ..... A47G 33/06

[52] U.S. Cl. ..... 428/20; 211/196; 211/205; 403/299

[58] Field of Search ..... D11/118; 211/196, 197, 211/205; 248/27.8; 362/123; 428/18, 19, 20; 403/299, 343

[56] References Cited

U.S. PATENT DOCUMENTS

| | | | |
|---|---|---|---|
| 2,126,457 | 8/1938 | East | D11/118 |
| 2,188,529 | 1/1940 | Corina | 362/123 |
| 2,604,214 | 7/1952 | Fussell | 211/196 X |
| 3,144,375 | 8/1964 | Day | 428/18 |
| 3,829,349 | 8/1974 | Hermanson | D11/118 X |

FOREIGN PATENT DOCUMENTS

| | | | |
|---|---|---|---|
| 560632 | 4/1957 | Italy | 428/20 |

*Primary Examiner*—Henry F. Epstein

*Attorney, Agent, or Firm*—Merrill N. Johnson

[57] ABSTRACT

Apparatus for removably connecting an artificial limb to the trunk of an artificial tree. The apparatus includes three major parts: a cylindrical stem plug designed to be inserted into the trunk of the artificial tree; an elongated bough fixture designed to be attached to the end of the artificial bough; and a ring-shaped connector for joining together the bough fixture and the stem plug. The bough fixture includes a projecting stem and a plurality of V-shaped teeth which fit respectively into an axially drilled hole and a plurality of V-shaped seats in the stem plug. The ring-shaped connector encircles the fixture and plug and holds them together by threads which screw onto the plug and a flange which rests against the fixture.

5 Claims, 5 Drawing Figures

BOUGH TO TREE TRUNK CONNECTION FOR ARTIFICIAL TREE

BACKGROUND AND SUMMARY OF THE INVENTION

The present invention relates to apparatus for connecting an artificial tree limb to the trunk of an artificial tree and more particularly to an easily removable connection between an artificial bough and the trunk of an artificial Christmas tree.

Today millions of artificial Christmas trees of various types are used each Holiday Season. Most of these trees are made to be disassembled so they can be stored away in a relatively small space until the next Holiday Season. The boughs and trunks of most artificial trees are made of molded plastic material and the boughs are attached to the trunk of the tree by plugging or screwing the end of the bough into a cylindrical, conical, hexagonal or threaded hole in the trunk of the plastic tree.

Such plastic-to-plastic joinder of bough to tree trunk has not proved entirely satisfactory. The cantilevered weight of the bough, especially when lights and ornaments are hanging from the bough, is often too much for the joint to bear, resulting in splitting, cracking or deformation of the trunk and/or the bough stem at the point of joinder with the trunk. Also, the joint usually cannot prevent undesired rotation or turning of the bough about the axis of its stem, causing misalignment of the generally flat bough with the other boughs of the tree.

Once the originally designed joinder between the bough and the tree trunk has been ruptured, whether by cracking or deformation of the hole in the trunk or by breaking or deformation of the stem of the bough, it becomes very difficult if not impossible to reassemble the tree the following Holiday Season. Thus the user of the artificial tree is dissatisfied with a tree which he expected to retain its original form for many years, rather than just one.

My invention provides an improved connection between a bough and the trunk of an artificial tree—a connection that will not split or deform the tree trunk or the bough, that locks the bough into a predetermined position from which it cannot rotate or slip, and that can be quickly and easily assembled or disassembled. Moreover, my unique connection is quite inexpensive and adds very little to the cost of manufacture of an artificial tree while guaranteeing the useful life of the tree for many years.

Basically, my bough-to-trunk connection includes three major components: a cylindrical stem plug designed to be cast or screwed into the plastic trunk of an artificial tree; an elongated bough end fixture; and a ring-shaped internally threaded connector for joining together the bough fixture and the stem plug. These three components may be made of brass, steel or high strength plastics such as Delrin.

The outer surface of the stem plug is threaded and a cylindrical hole is drilled axially in the front face of the plug. A plurality of V-shaped seats are cut or cast in the front face of the plug arranged circumferentially around the axial hole.

The bough end fixture has a cylindrical base, an axially centered stem projecting from the front face of the base and a plurality of V-shaped teeth on the front face of the base circumferentially spaced around the axial stem. These teeth are designed to fit into the V-shaped seats in the front face of the plug and the stem is designed to fit into the hole in the front face of the plug. A cyindrical shaft extends from the rear face of the fixture's base and a hole is drilled axially in this shaft. The end of the artificial bough is affixed to this shaft and its axial hole.

The connector is designed to encircle and hold together the joined fixture and plug by internal threads which mesh with the threaded outer surface of the plug and by an annular flange at the rear of the connector which bears against the rear face of the fixture. Preferably the outer surface of the connector is knurled to provide for easy assembly and disassembly of the threaded connection between the ring-shaped connector and the stem plug.

DESCRIPTION OF THE PREFERRED EMBODIMENT

The drawings illustrate a preferred embodiment of my unique bough to tree trunk connection for an artificial Christmas tree, it being understood that my connection is not limited to use on Christmas trees but can be used on any type of artificial tree of foliage which is designed to be assembled and disassembled.

Figure 1:
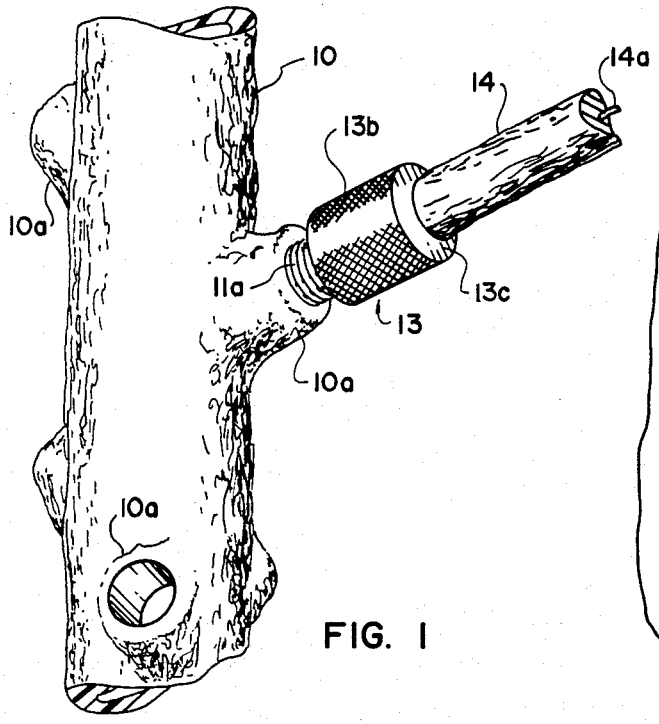
FIG. 1 is a perspective view partially broken away showing a preferred embodiment of my bough to tree trunk connection for an artificial Christmas tree.

FIG. 1 shows a section of an artificial Christmas tree trunk 10 conventionally made of a cast or molded thermoplastic material such as a polyester resin. Tree trunk 10 includes a plurality of randomly spaced bough stems 10*a*, each of which is made with an axial cylindrical hole in its center.

Figure 2:
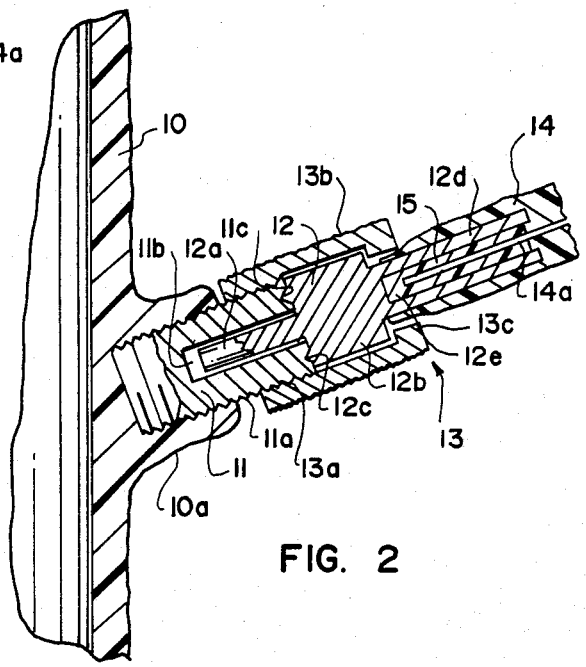
FIG. 2 is a detailed cross-sectional side view of the connection shown in FIG. 1.
Figure 3:
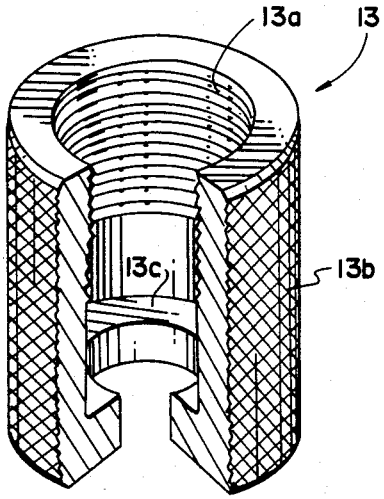
FIG. 3 is a detailed perspective view partially broken away showing the construction of the ring-shaped connector shown in FIGS. 1 and 2.

As shown in FIGS. 1 and 2, an externally threaded plug 11 is screwed into the hole of each stem 10*a*, leaving about one half of the cylindrical plug and its external threads 11*a* remaining outside the stem 10*a*. Plug 11 as shown is made of cadmium plated brass but may be made of such other materials as steel or high strength plastic. Each plug includes an axial cylindrical hole 11*b* in its front face which also includes preferably twelve V-shaped seats 11*c* equally spaced circumferentially about hole 11*b*.

Figure 4:
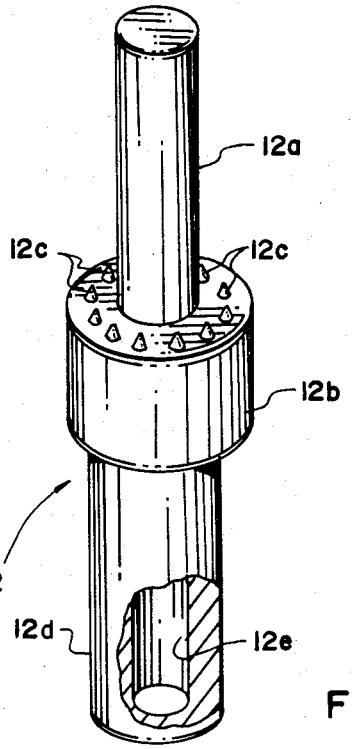
FIG. 4 is a detailed perspective view partially broken away of the bough end fixture shown in FIG. 2.

FIGS. 1 and 2 show the end of an artificial Christmas tree bough 14 conventionally of thermoplastic resin molded about a supporting steel core 14*a*. FIG. 4 shows the construction of bough end fixture 12 and FIG. 2 illustrates the joinder of fixture 12 onto the end of bough 14.

Fixture 12 includes a cylindrical stem 12*a* designed to fit within hole 11*b* of plug 11. The stem projects axially from the front face of the fixture's cylindrical base 12*b*. The front face of base 12*b* also includes preferably twelve V-shaped teeth 12*c* designed to fit within the twelve seats 11*c* of plug 11 when stem 12*a* is inserted into hole 11*c*.

Figure 5:
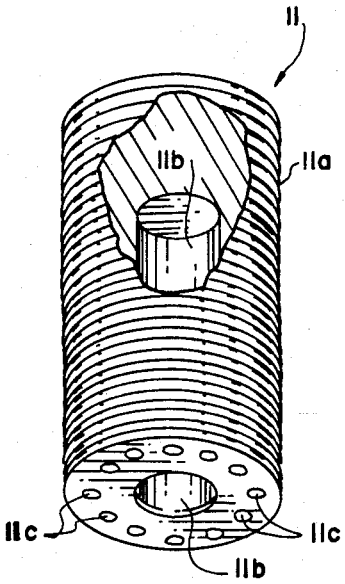
FIG. 5 is a detailed perspective view partially broken away showing the construction of the stem plug shown in FIGS. 1 and 2.

A cylindrical shaft 12*d* projects from the rear face of the fixture's base 12*b* and a hole 12*e* is drilled axially into shaft 12*b* as best shown in FIG. 5. Bough 14 is joined to fixture 12 by first stripping the plastic off the end of core 14*a* so that the end of the core will fit down into hole 12*e* and the plastic end of bough will fit around shaft 12*d* as shown in FIG. 2. Hole 12*e* and the outside of the end of shaft 12*d* are coated with a self-hardening adhesive 15 such as a two-part epoxy which firmly bonds the bough and its core to the shaft of fixture 12.

Before the bough is joined to fixture 12, connector 13 is slipped over the shaft 12*d*. Connector 13 is a hollow cylinder whose inner diameter is slightly larger than the outer diameter of fixture base 12*b* with the front portion 13*a* of its inner diameter threaded to mesh with the threads 11*a* of plug 11. Connector 13 has a rear annular flange 13*c* designed to fit against the rear face of fixture base 12*b* when the connector is screwed onto plug 11. The connector has a knurled outer surface 13*b* to facilitate threading the connector unto plug 11 and this outer surface preferably has a dull dark finish to blend with the finish of the bough and three trunk.

Bough 14 is assembled onto tree trunk 10 by inserting stem 12*a* of bough end fixture 12 part way into hole 11*b* of stem plug 11. The generally flat foliage of the bough is adjusted into its desired position by rotation of the bough about stem 12*a* within hole 11*b*. When the bough is in the desired position, stem 12 is then pushed all the way within hole 11*b* so that the teeth 12*c* of fixture 12 will be seated in seats 11*c* in the front face of plug 11.

Bough 14 is then locked into its desired position by threading connector 13 onto plug 11 until flange 13*c* is pressed against the rear face of fixture base 12*b*. The assembled connection is shown in FIG. 2. Disassembly involves only a reversal of the assembly operation just described and can be accomplished time after time quickly and without danger of splitting, cracking or deformation of either the boughs or the trunk of the artificial tree.

While a preferred embodiment of my bough to tree trunk connection has been illustrated and described, changes in form and dimension of the components will be apparent to those skilled in the art. For example, instead of the conical V-shaped teeth shown in the drawings, the teeth could be in various other forms including a saw-shaped rim around the outer edge of base 12*b* which seat into a saw-toothed cut into the rim of plug 11. Likewise, the end of stem 12*a* may be rounded to facilitate its insertion into hole 11*b*. The foregoing description is in no way intended to limit my invention, whose spirit and scope is limited only by the following claims.

I claim:

1. Apparatus for removably connecting an artificial bough to the trunk of an artificial tree comprising:

a cylindrical externally threaded stem plug one end of which is inserted into the trunk of an artificial tree, an elongated bough end fixture attached to the end of an artificial bough, and an internally threaded ring-shaped connector encircling the bough end fixture and screwed onto the threaded stem plug to join together the fixture and the stem plug.

2. Apparatus for removably connecting an artificial bough to the trunk of an artificial tree comprising:

a cylindrical externally threaded stem plug one end of which is inserted into the trunk of an artificial tree, said plug having an axial cylindrical hole in its exposed circular face, a bough end fixture attached to the end of an artificial bough, said fixture having a cylindrical stem sized to fit within the hole in said stem plug, and an internally threaded ring-shaped connector encircling the bough end fixture and screwed onto the stem plug to join together the fixture and the plug.

3. Apparatus for connecting an artificial bough to the trunk of an artificial tree as set forth in claim 2 in which the bough end fixture includes a plurality of V-shaped teeth and the stem plug includes a plurality of V-shaped seats sized and positioned to receive the teeth of the fixture when the stem of the fixture is inserted into the hole in the plug.

4. Apparatus for removably connecting artificial bough to the trunk of an artificial tree comprising:

a cylindrical externally threaded stem plug one end of which is inserted into the trunk of an artificial tree, said plug having an axial cylindrical hole and a plurality of V-shaped seats in its exposed circular face, a bough end fixture attached to the end of an artificial bough, said fixture having a cylindrical stem which fits within the hole in said stem plug and said fixture also having a plurality of V-shaped teeth sized and positioned to seat within the V-shaped seats of the stem plug when the stem of the fixture is inserted into the hole in the stem plug, and an internally threaded ring-shaped connector encircling the bough end fixture and having an annular rear flange, said connector being threadedly connected to the stem plug with the connector's annular flange resting against the bough end fixture.

5. Apparatus according to claims 2 or 4 in which the bough end fixture includes a hollow shaft axially projecting from the rear of the fixture and the artificial bough includes a metal wire core and the bough is affixed to the bough end fixture by inserting the end of the bough wire core into the hollow shaft of the fixture filled with a self-hardening adhesive.

* * * * *